US005673605A

United States Patent [19]

Chung

[11] Patent Number: 5,673,605

[45] Date of Patent: Oct. 7, 1997

[54] MOTOR CAVITATION PREVENTION DEVICE FOR HYDRAULIC SYSTEMS

[75] Inventor: Dae Seung Chung, Pusan, Rep. of Korea

[73] Assignee: Samsung Heavy Industries Co. Ltd., Seoul, Rep. of Korea

[21] Appl. No.: 497,041

[22] Filed: Jun. 30, 1995

[30] Foreign Application Priority Data

Sep. 30, 1994 [KR] Rep. of Korea ..... 94-25152

[51] Int. Cl.[6] ..... F15B 13/04

[52] U.S. Cl. ..... 91/28; 91/436

[58] Field of Search ..... 91/28, 436

[56] References Cited

U.S. PATENT DOCUMENTS 3,426,647 2/1969 Martin et al. ..... 91/436

5,022,434 6/1991 Tsukimoto ..... 91/436

*Primary Examiner*—F. Daniel Lopez

*Attorney, Agent, or Firm*—Kenyon & Kenyon

[57] ABSTRACT

A motor cavitation prevention device for hydraulic systems is disclosed. The device exerts no influence upon return fluid of any actuators other than the hydraulic motor thereby preventing undesired pressure loss of the return line. The device has valve means installed in a given position of the return line such that the return fluid of the motor necessarily passes the check valve prior to returning to a return tank but the return fluid of the other actuators does not pass the check valve, and a feedback line for feeding the return fluid of the motor back to the motor in the ease of generation of the pressure above tank in the return line, one end of which feedback line is connected to the return line at the front of the check valve but the other end of which feedback line is connected to the motor.

3 Claims, 4 Drawing Sheets

MOTOR CAVITATION PREVENTION DEVICE FOR HYDRAULIC SYSTEMS

BACKGROUND OF THE INVENTION

1. Field of the Invention

The present invention relates in general to cavitation prevention devices for hydraulic power-operated motors of hydraulic systems of, for example, power excavators, and, more particularly, to the arrangement of booster check valves installed in a return line of the system and used for preventing possible cavitation of the motors, such as swing motors and travelling motors, of the system due to a shortage of pressurized fluid.

2. Description of the Prior Art

As well known to those skilled in the art, cavitation in a hydraulic power-operated motor (hereinbelow, referred to simply as "the hydraulic motor" or "the motor") of a hydraulic system maybe generated when the supply fluid flow for the motor is less than the return fluid flow of the motor. In the case of generation of motor cavitation the hydraulic system, particularly the motor, will be severely damaged. In order to prevent possible cavitation in the motor, valve means (for example, a pressure relief valve can be used) are installed in the return line of the system to generate appropriate pressure above tank in the return line and to compensate for the pressurized fluid shortage of the motor.

FIG. 1 is a hydraulic circuit diagram of part of a typical hydraulic system of a construction vehicle, such as power excavator or a power shovel. As shown in this drawing, a plurality of actuators of the hydraulic system are operated by pressurized fluid delivered from a hydraulic pump P. The actuators include a plurality of hydraulic cylinders and a plurality of hydraulic motors. Please note that one of the motors is shown in the drawing, which is denoted by the reference numeral 101. In the above system, valve means 103 are installed in a return line 102 as described above to generate appropriate pressure above tank in the line 102. The negative pressure in the line 102 causes feedback of the return fluid of the motor 101 through a feedback line 104, thus to compensate for the pressurized fluid shortage of the motor 101 and to prevent possible cavitation of the motor 101 due to the fluid shortage. In FIG. 1, the reference alphabets A, B, C and D denote directional control valves for controlling operation of the actuators, including the motor 101, by controlling flow direction of the pressurized fluid for the actuators.

However, the above system causes a load in the system when any one of the actuators other than the motor 101 is operated. Due to the load generated in the system, there is generated pressure loss when the pressurized fluid passes the valve means 103. The above problem is caused by both the fact that the branch return lines 102*a*, 102*b*, 102*c* and 102*d* of the directional control valves A, B, C and D join the main return line 102 prior to returning of the pressurized fluid to the return tank T and the fact that the valve means 103 are installed in the main return line 102 after Joining of the return lines. That is, as the return fluid from any actuator should pass the valve means 103 of the line 102 prior to returning to the tank T, desired smooth returning of the fluid from the actuators other than the motor 101 to the tank T can not be achieved and undesired pressure loss is caused in the booster check valve 103.

SUMMARY OF THE INVENTION

It is, therefore, an object of the present invention to provide a motor cavitation preventing device for hydraulic systems in which the above problems can be overcome and which exerts no influence upon return fluid of any actuators other than the motor and thereby preventing undesired pressure loss of valve means.

In order to accomplish the above object, the invention provides a motor cavitation preventing device for hydraulic systems with a plurality of actuators, including a hydraulic motor, operated by pressurized fluid of a hydraulic pump, wherein the improvement comprises means for generating, in the case of returning return fluid out of the hydraulic motor to a return tank, a given pressure above tank in a return line and thereby feeding the return fluid of the motor back to the motor, but for letting, in the case of returning return fluid out of the actuators other than the hydraulic motor, the return fluid of the other actuators be directly returned to the return tank without resistance.

In the preferred embodiment of this invention, the means includes valve means installed in a given position of the return line such that the return fluid out of the motor necessarily passes the check valve prior to returning to the return tank but the return fluid out of the other actuators does not pass the check valve, and a feedback line for feeding the return fluid of the motor back to the motor in the case of generation of the pressure above tank in the return line, one end of which feedback line is connected to the return line at the front of the check valve but the other end of which feedback line is connected to the motor.

BRIEF DESCRIPTION OF THE DRAWINGS

The above and other objects, features and other advantages of the present invention will be more dearly understood from the following detailed description taken in conjunction with the accompanying drawings, in which.

DESCRIPTION OF THE PREFERRED EMBODIMENTS

Figure 1:
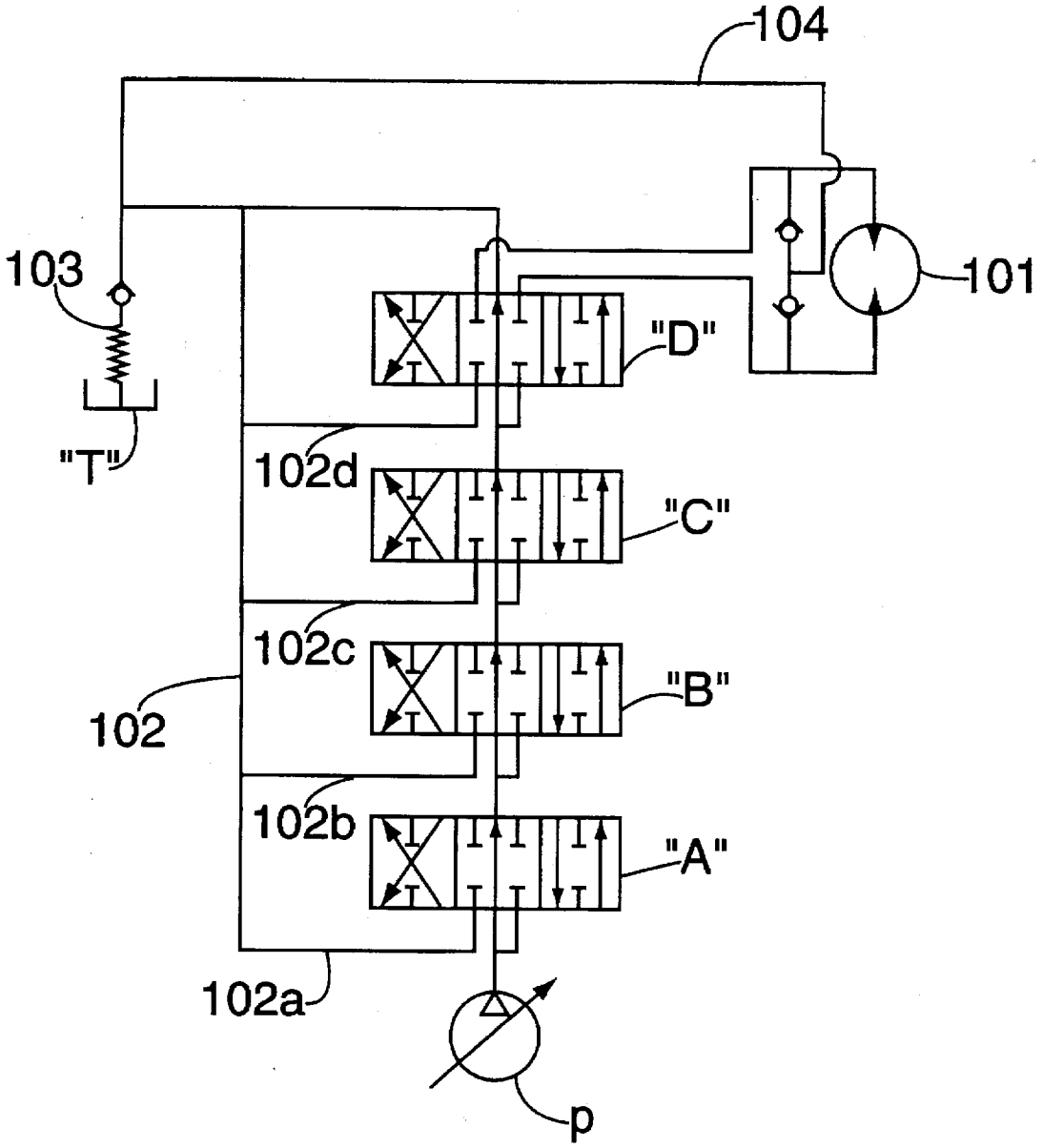
FIG. 1 PRIOR ART
FIG. 1 is a circuit diagram of a hydraulic system provided with a typical motor cavitation preventing device.
Figure 2:
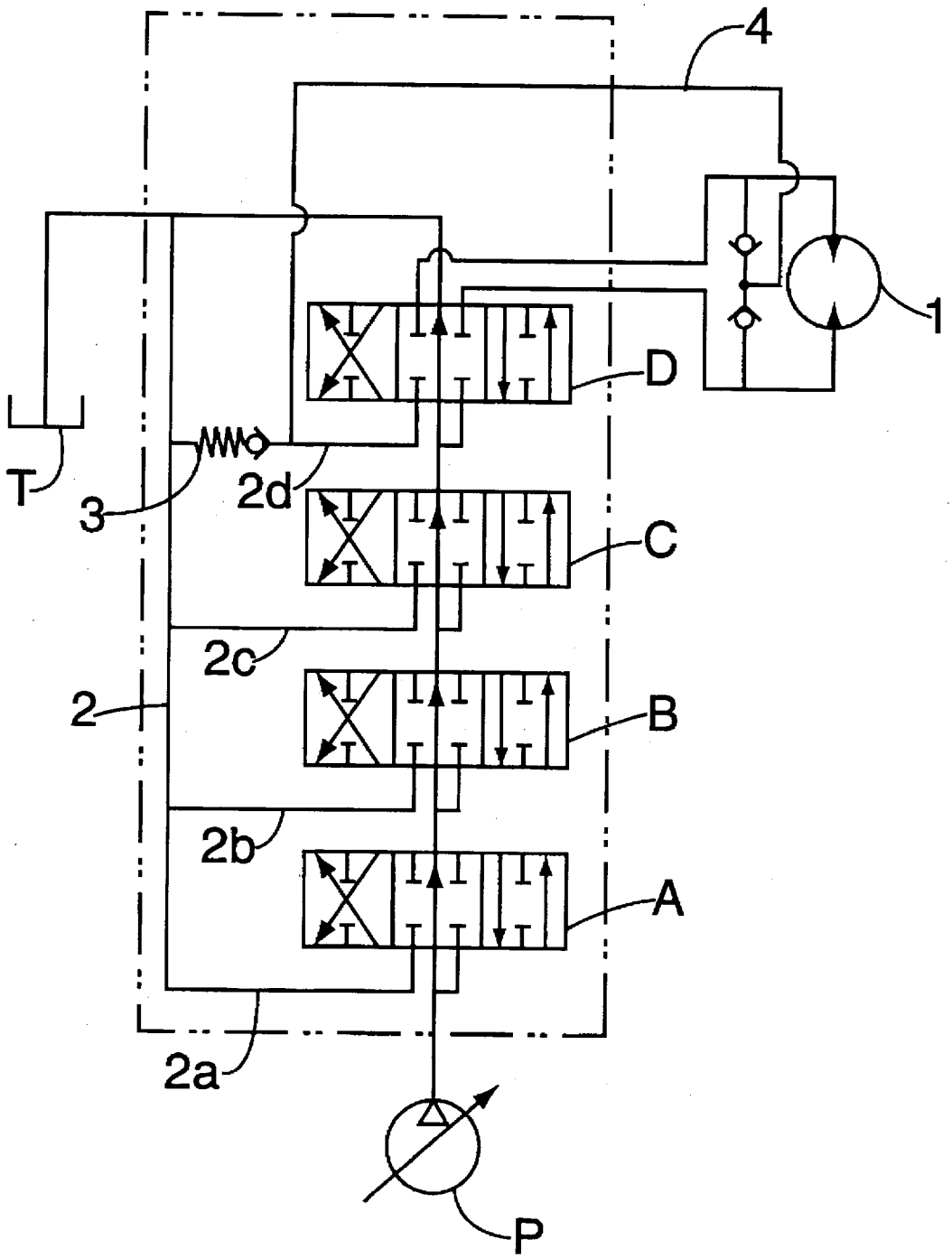
FIG. 2 is a circuit diagram of a hydraulic system provided with a motor cavitation preventing device in accordance with a preferred embodiment of the present invention.
Figure 2A:
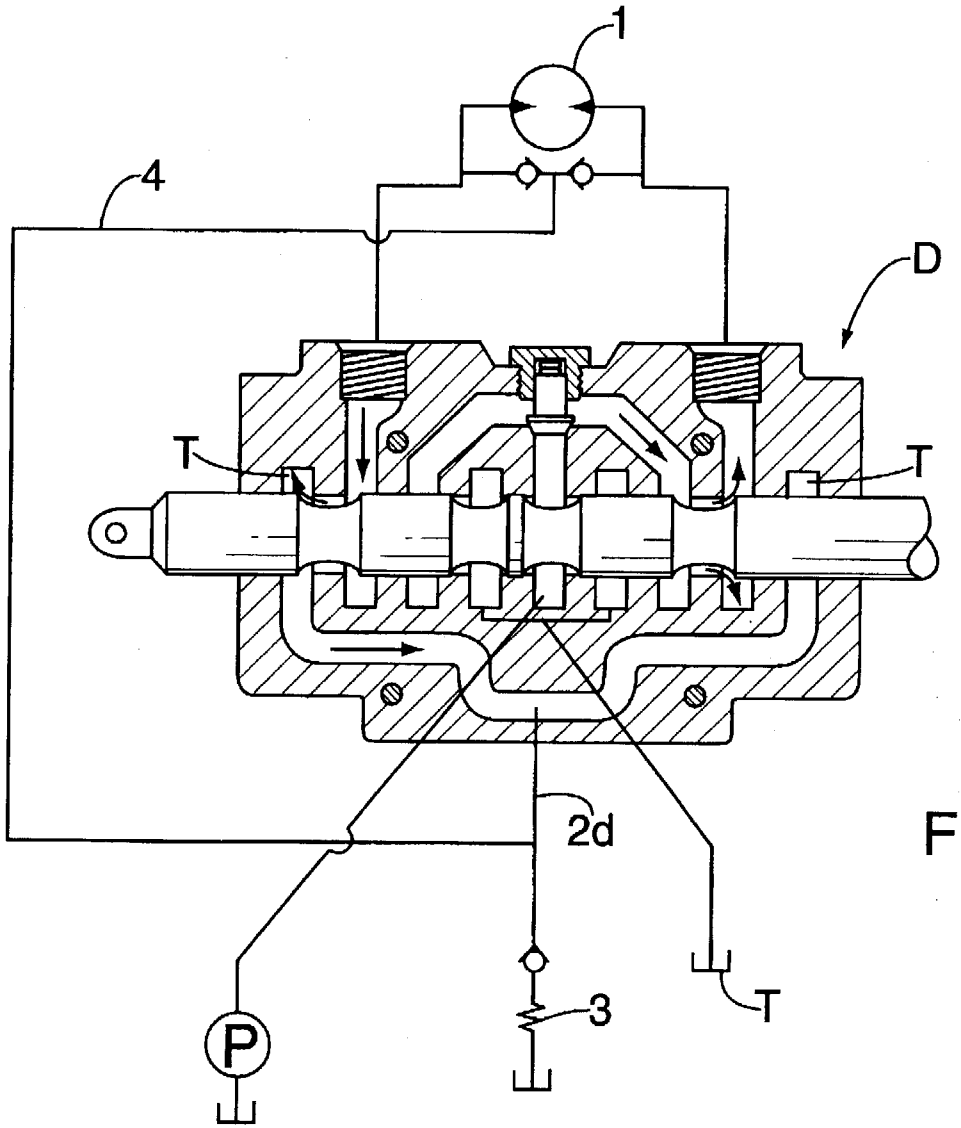
FIG. 2A and 2B are detailed drawings of portions of FIG. 2.
Figure 2B:
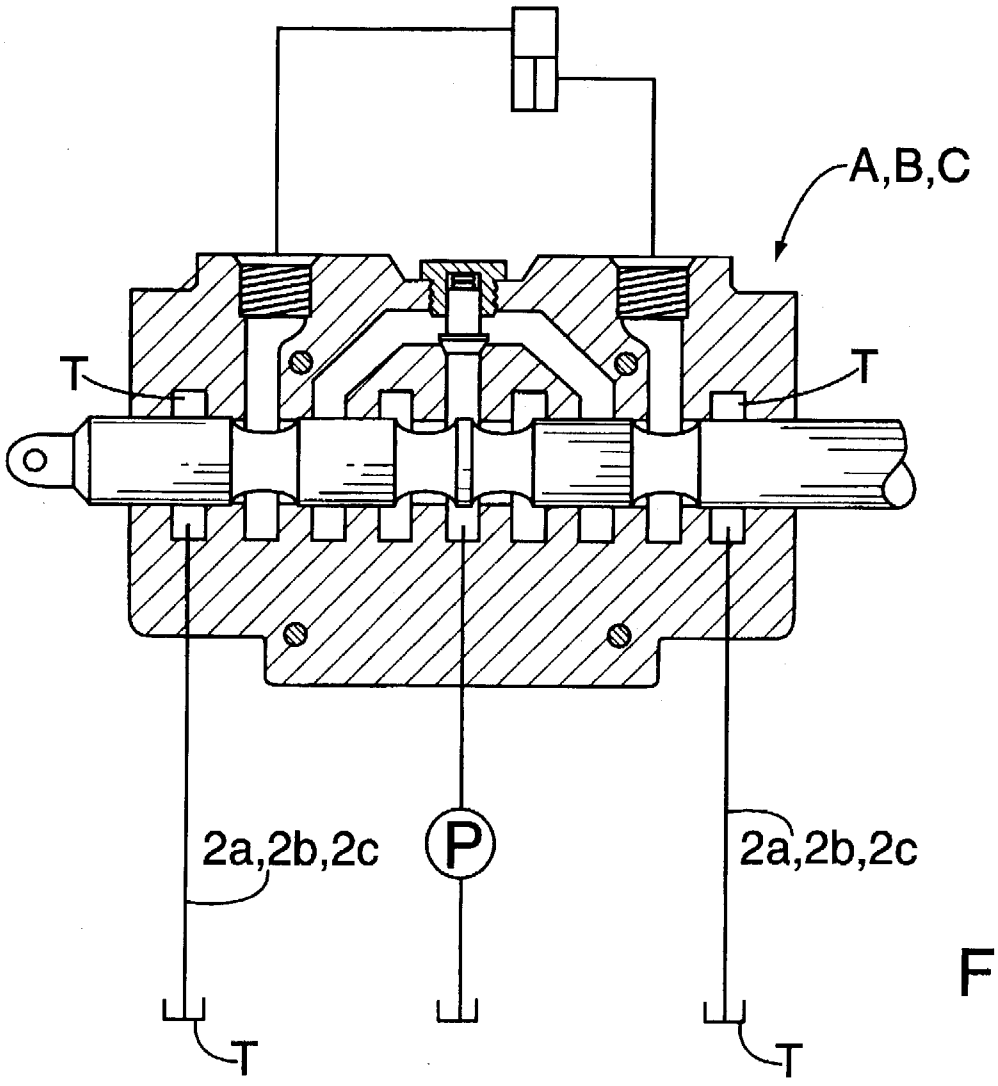

With reference to FIG. 2, there is shown a hydraulic system provided with a motor cavitation preventing device in accordance with a preferred embodiment of the present invention.

As shown in the drawing, a plurality of actuators of the system are operated by pressurized fluid delivered from a hydraulic pump P. The actuators include a plurality of hydraulic cylinders and a plurality of hydraulic motors. If letting the system is for a power excavator, the hydraulic motors include a swing motor and a pair of travelling motors. Please note that one of the motors is shown in the drawing, which is denoted by the reference numeral 1. In FIG. 2, the reference alphabets A, B, C and D denote directional control valves for controlling operation of the actuators, including the motor 1, by controlling flow direction of pressurized fluid for the actuators.

In the above system, the cavitation preventing device includes a valve means 3 installed in given position of a main return line 2. In this system, the return fluid of the motor I necessarily passes the given position of the line 2 prior to returning to a return tank T but the return fluid of the other actuators does not pass the given position of the line 2 prior to returning to the tank T. The device also includes a feedback line 4, one end of which line 4 is connected to the return line 2 at the front of check valve 3 but the other end of which line 4 is connected to the motor 1. That is, the given position of the return line 2, where the valve means 3 are installed, is the position of the line 2 before a branch return line 2*d* extending from the control valve D of the motor 1 joins branch return lines 2*a*, 2*b* and 2*c* of the control valves A, B and C of the other actuators.

In operation of the above cavitation preventing device, there will be generated a given pressure above tank in the return line 2*d* of the motor 1 when the return fluid of the motor 1 is returned to the tank T, which pressure above tank is caused by the return fluid of the motor 1 passing through the valve means 3. Due to the negative pressure in the return line 2*d*, feedback of the return fluid of the motor 1 through the feedback line 4 is achieved. That is, a part of the return fluid out of the motor 1 flows backward to the motor 1 through the feedback line 4 so that possible cavitation of the motor 1 due to lacking of pressurized fluid of the motor 1 can be effectively prevented. However, in the case of the return fluid out of actuators other than the motor 1, the return fluid is returned to the tank T through their associated return lines 2*a*, 2*b* and 2*c* and through the main return line 2. (In FIG. 2 the parallel return lines of the control valve for the actuators is replaced by a single return line for the purpose of illustration). In this case, as the valve means 3 are installed in the return line 2*d* of the motor 1, the return fluid out of the actuators other than the motor 1 does not pass the booster check valve 3 but can be directly returned to the tank T without any resistance.

The cavitation preventing device of this invention may be used in a hydraulic system whose directional control valves A, B, C and D are so-called mono block control valves comprising sections formed in a single cast body as well as in the above hydraulic system whose directional control valves A, B, C and D are separately installed in the system. However, in order to let the valve means 3 exclusively exert an influence on the return fluid of the motor 1 in the case of the instant device used in the system having the above mono block control valves, the left and right return lines of a section of the single cast body, which section acts as the directional control valve of the motor 1, should be connected to each other by way of a connection line and the valve means 3 should be installed in the connection line of the left and right return lines. Early examples of the above mono block control valves are this applicant's "Mono Block Control Valve with Side Bypass Line", Korean Pat. Appln. No. 94-24400 filed on Sep. 28, 1994, and this applicant's "Mono Block Control Valve with Connected Return Lines", Korean Pat. Appln. No. 94-24709 filed on Sep. 29, 1994.

As described above, the motor cavitation prevention device of the present invention is used in the hydraulic system of a construction vehicle, such as a power excavator, and generates appropriate pressure above tank in the return line of the system and feeds return fluid of the hydraulic motor back to the motor, thus effectively preventing possible cavitation of the motor due to a shortage of pressurized motor fluid. Valve means the device exert no influence upon return fluid of actuators other than the motor but lets the return fluid of the other actuators be smoothly returned to the return tank without any generated pressure loss.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A motor cavitation prevention device for a hydraulic system including a single hydraulic pump, a plurality of actuators driven by the hydraulic pump, at least one of said actuators being a hydraulic motor, a plurality of control valves for operating said actuators, respective supply lines for passage of supply fluids to the control valves, respective return lines for passage of return fluids from the control valves and a combined line combining the return fluids from the respective return lines and discharging said fluids to a return tank, said motor having a first line and a second line for communicating with a control valve of the motor, a branch line connecting the first line with the second line and two check valves installed in the branch line at a predetermined interval, said check valves allowing a fluid to flow to the first and second line from a predetermined position between the two check valves and preventing the fluid from flowing in the opposite direction, comprising:

valve means installed in said return line at a given position such that the return fluid out of the motor necessarily passes through the valve means prior to returning to said return tank, but such that the return fluid out of other actuators does not pass through the valve means; and a feedback line, one end of said feedback line being connected to the return line in front of said valve means and another end of said feedback line being connected to the branch line at said predetermined position between the two check valves, wherein a part of the return fluid is fed back to the motor for compensating for a pressurized fluid shortage of the motor.

2. The motor cavitation prevention device according to claim 1, wherein said valve means is installed in a return line from the control valve for the hydraulic motor in front of a position where the return line is combined to the combined line.

3. A motor cavitation prevention device for a hydraulic system including a single hydraulic pump, a plurality of actuators driven by the hydraulic pump, at least one of said actuators being a hydraulic motor, a plurality of directional control valves for operating the actuators, respective supply lines for passage of supply fluids to the control valves, respective return lines for passage of return fluids from the control valves, and a combined line for combining the return fluids from the respective return lines and discharging them to a return tank, said motor having a first line and a second line for supplying or discharging a fluid to or from the motor, a branch line connecting the first line with the second line and two check valves installed in the branch line at a predetermined interval, said check valves allowing a fluid to flow to the first and second lines from a predetermined position between the two check valves and preventing the fluid from flowing in an opposite direction, wherein the directional control valves of said actuators are mono block control valves formed in a single body, comprising:

valve means installed in the return line from the control valve for the hydraulic motor in front of a position where said return line is joined with the combined line;

a feedback line, one end of said feedback line being connected to the return line at a position upstream of said valve means and another end of said feedback line being connected to the branch line at said predetermined position between the two check valves, wherein a part of the return fluid is fed back to the motor for compensating for a shortage of pressurized fluid in the motor.

* * * * *